United States Patent [19]

Nakajima et al.

[11] 4,334,513

[45] Jun. 15, 1982

[54] ELECTRONIC FUEL INJECTION SYSTEM FOR INTERNAL COMBUSTION ENGINE

[75] Inventors: Makoto Nakajima, Oiso; Masaru Naramura, Yokohama, both of Japan

[73] Assignee: Nissan Motor Co., Ltd., Yokohama, Japan

[21] Appl. No.: 163,505

[22] Filed: Jun. 27, 1980

[30] Foreign Application Priority Data

Jun. 29, 1979 [JP] Japan ..... 54-82229

[51] Int. Cl.[3] ..... F02B 3/00

[52] U.S. Cl. ..... 123/494; 123/492

[58] Field of Search ..... 123/494, 492

[56] References Cited

U.S. PATENT DOCUMENTS

| | | | |
|---|---|---|---|
| 3,106,196 | 10/1963 | Woodward | 123/492 |
| 3,583,374 | 6/1971 | Scholl | 123/492 |
| 3,898,962 | 8/1975 | Honig | 123/492 |
| 3,919,981 | 11/1975 | Reddy | 123/492 |
| 3,983,850 | 10/1976 | Stumpp | 123/492 |
| 4,131,088 | 12/1978 | Reddy | 123/492 |
| 4,149,494 | 4/1979 | Wolfinger | 123/492 |
| 4,184,458 | 1/1980 | Aoki | 123/492 |
| 4,187,812 | 2/1980 | Hosaka | 123/492 |
| 4,202,295 | 5/1980 | Kondo | 123/492 |
| 4,223,643 | 9/1980 | Glockler | 123/492 |

*Primary Examiner*—Ronald B. Cox

*Attorney, Agent, or Firm*—Lowe, King, Price & Becker

[57] ABSTRACT

In an electronic fuel injection system for an internal combustion engine, a vacuum switch and a throttle valve switch respectively monitor the intake manifold pressure and the opening of the throttle valve. Fuel enrichment is achieved in response to these two switches in such a manner that the fuel enrichment is performed even in the case of low speed and relatively high load engine operating conditions, as well as at full throttle. In such a low speed, relatively high load range, the amount of fuel enrichment may be less than at full throttle. Optionally the fuel enrichment is achieved only by the vacuum switch without the throttle switch. The vacuum switch optionally has an altitude compensation mechanism.

7 Claims, 7 Drawing Figures

ELECTRONIC FUEL INJECTION SYSTEM FOR INTERNAL COMBUSTION ENGINE

BACKGROUND OF THE INVENTION

This invention relates to an electronic fuel injection system for an internal combustion engine and more particularly to an electronic fuel injection system which has a vacuum sensor for sensing the intake manifold pressure, in addition to or without a throttle position sensor, so as to actuate fuel enrichment properly especially for the engine operating ranges associated with low and high speed loads.

In a conventional electronic fuel injection system, a throttle valve switch produces a fuel enrichment correction signal in response to the throttle valve exceeding a predetermined opening degree. An injector open-valve time period is increased in response to this correction signal to achieve the fuel enrichment. However, usually the throttle valve is not opened to such an extent as to actuate a throttle valve switch for a relatively low speed operational range, as in the case of running in an urban district.

If the amount of exhaust gas recirculation (EGR) is increased to reduce exhaust gas nitrogen oxides (NOx) for relatively low speeds and relatively high loads, various undesirable results occur because the EGR amount is increased without fuel enrichment. Examples of the undesirable results are: deterioration in performance, troubles resulting from intake passage overheating and formation of hard deposits, such as carbon sediments which cause part sticking and clogging of the intake passage. On the other hand, if the air/fuel ratio is always maintained at a richer level to avoid such problems, then fuel comsumption is badly influenced.

BRIEF SUMMARY OF THE INVENTION

It is an object of the present invention to provide a new and improved electronic fuel injection system for an internal combustion engine which system is arranged to achieve proper fuel enrichment, especially range for low speed and high load engine operation by, allowing exhaust gas recirculation to control nitrogen oxide emissions while maintaining good engine performance.

According to the present invention, vacuum sensing means for the intake manifold pressure and means for achieving fuel enrichment are provided in an electronic fuel injection system of an internal combustion engine. The electronic fuel injection system has means for sensing the engine speed, means for measuring the rate of air flow entering the engine and, means for calculating optimum fuel injection quantity in accordance with the sensed engine speed and the measured air flow rate to derive a command signal. A fuel injector means injects a regulated quantity of fuel into the engine in response to the command signal. The vacuum sensing means produces a signal to actuate the fuel enrichment means when the absolute valve of the intake manifold absolute pressure is below a predetermined value. The fuel enrichment means achieves the fuel enrichment by modifying the command signal of the calculating means in response to the actuating signal when the absolute value of the intake manifold pressure is below the predetermined value. With this arrangement the fuel injection quantity can be enriched properly, especially for low speed and relatively high load engine operating conditions. Optionally, in addition to the vacuum sensing means, there is further provided throttle position sensing means for sensing the degree of the throttle valve opening and for producing another actuating signal to actuate the fuel enrichment means. The fuel enrichment means achieves the fuel enrichment by modifying the command signal when either or both of the two actuating signals from the vacuum sensing means and the throttle position sensing means is present.

Optionally the fuel enrichment means is so arranged that the amount of the fuel enrichment decreases when only the actuating signal from the vacuum sensing means is present compared to the case for the actuating signal from the throttle position sensing means being present.

DESCRIPTION OF THE PREFERRED EMBODIMENTS

Figure 1:
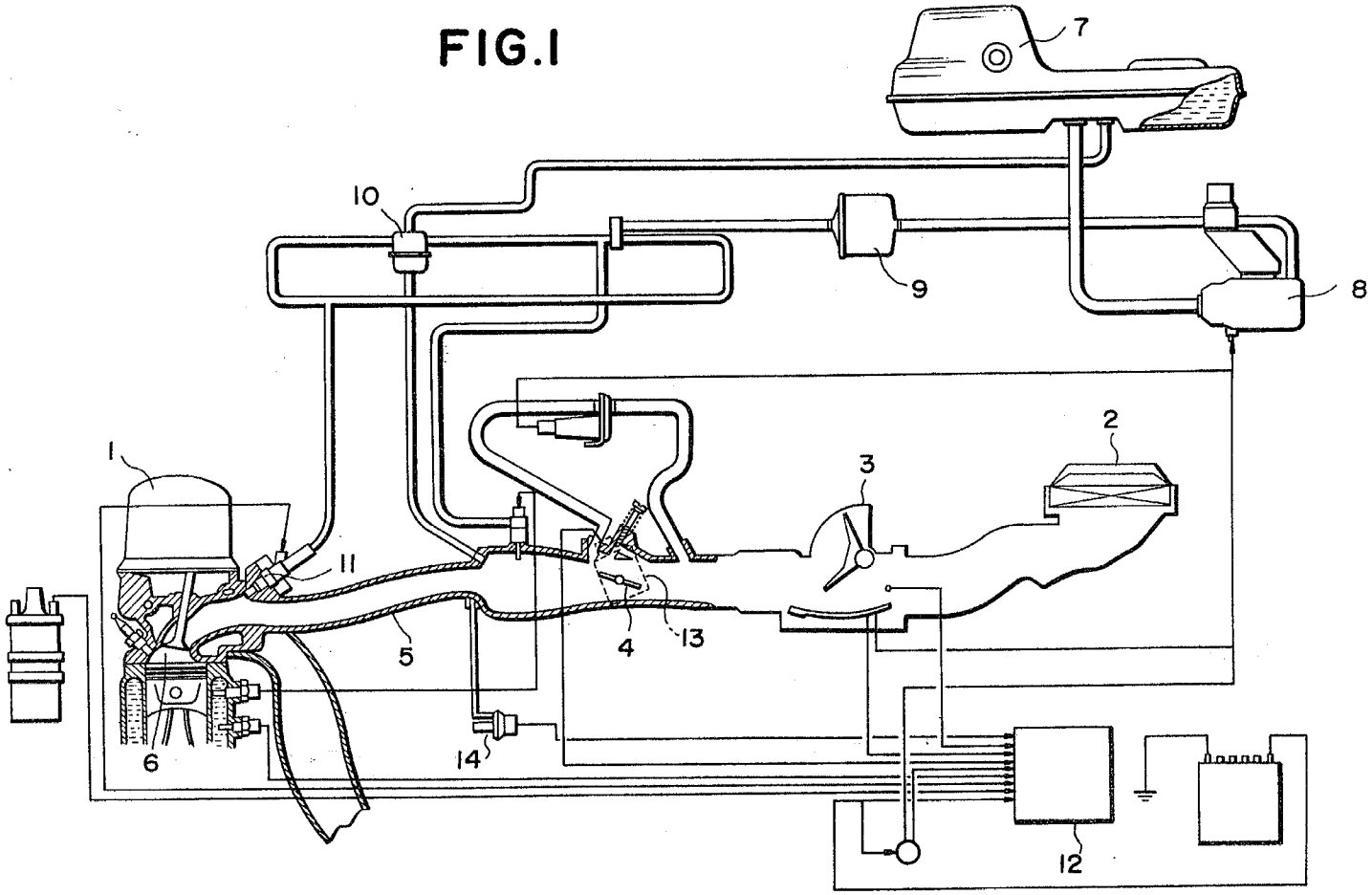
FIG. 1 is a sectional view showing schematically the whole system according to the present invention.

Referring to FIG. 1, intake air to an engine 1 is supplied from an air cleaner 2, metered at an air flowmeter 3 and flows through a throttle valve 4 disposed in an induction passage 5 and then into a combustion chamber 6 of the engine 1. Fuel is sucked from a fuel tank 7 by a fuel pump 8 and, after filtered in a fuel filter 9, introduced to a fuel pressure regulator 10 which supplies fuel at constant pressure to a fuel injector 11. Excessive fuel is returned through the fuel pressure regulator 10 to the fuel tank 7. Fuel is injected into the intake manifold branch of the engine 1 by the fuel injector 11. The quantity of fuel supplied to engine 1 by injector 11 is determined by the injector open-valve time period in turn determined by the width, i.e. duration, of a command pulse signal generated by an electronic control unit (ECU) 12.

The ECU 12 establishes this pulse width according to information (electrical signals) from various sensor located strategically around the engine. The engine rpm and the air flow rate measured by the air flowmeter 3 are the two main and basic input data supplied to ECU 12 for establishing the width of the pulse signal supplied to injector 11. For performing fuel enrichment for relatively low speed and relatively high load engine operation, there are provided a throttle valve switch or throttle position sensor 13 for detecting a predetermined opening degree of throttle valve, and a vacuum switch or vacuum sensor 14 for detecting a predetermined intake vacuum pressure in passage 5. Switches 13 and 14 are arranged in parallel electric circuits so when either or both of the switches is actuated, ECU 12 receives an enrichment correction signal or actuating signal the ECU responds to the actuated switch(es) to increase the injection pulse width according to a program therein. This fuel enrichment may be made optional by the vacuum switch alone without the throttle switch, as will be described later.

Figure 2:
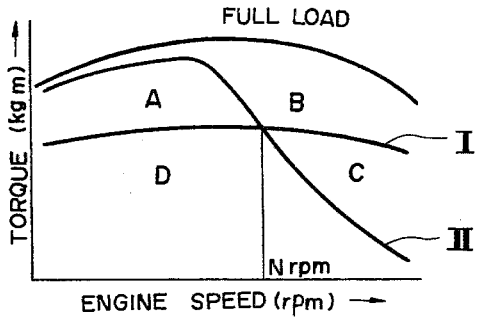
FIG. 2 is a diagram illustrating the operation of the present invention.

FIG. 2 is an illustration of engine operating ranges where fuel enrichment is required. Curves I and II respectively indicate torque in kg.m vs. engine speed in rpm for constant manifold vacuum curve (−160 mmHg) and for a constant throttle opening (45°). Under a certain engine rotational speed of N rpm, for example, 4000 rpm, the vacuum switch (set point, −160 mmHg) is actuated before the throttle switch (set point, 45 degree) is actuated. Accordingly fuel enrichment is achieved in the range A, where fuel enrichment can not be achieved if only a throttle switch is provided. Thus, according to the present invention, the fuel is enriched for relatively low speed and relatively high load engine operating conditions so that EGR can be performed to reduce oxides of nitrogen in the exhaust gases without unfavorably affecting the engine performance.

Figure 3:
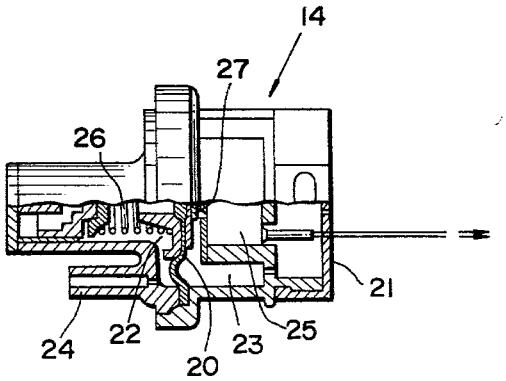
FIGS. 3–6 are sectional views showing various modifications of the vacuum switch according to the present invention.

FIG. 3 is an illustration of vacuum switch 14 in detail. A diaphragm 20 is disposed in a housing 21 and divides the housing into two chambers, a vacuum chamber 22 and an air chamber 23. The vacuum in induction passage 5 is introduced into the vacuum chamber 22 through a vacuum conduit 24. When the diaphragm 20 is deflected toward the air chamber 23 by the aid of a spring 26, a push rod 27 secured to the diaphragm 20 pushes a microswitch 25, a small switch in which contact is made or broken by a slight motion. Microswitch 25 is arranged to be turned on (or off) when pushed by the push rod 27.

In normal operating conditions of engine 1 or a vehicle including the engine, a negative pressure of a large absolute value in the induction passage is introduced into the vacuum chamber 22, causing diaphragm 20 to be deflected toward the vacuum chamber 22 against the force of the spring 26 by the force of the differential pressure between the vacuum in the vacuum chamber 22 and atmospheric pressure in the air chamber 23. In this case the push rod 27 is spaced from the microswitch 25, whereby vacuum switch 14 is in an OFF position, where no fuel enrichment signal is produced.

During acceleration of engine 1, the absolute value of the intake vacuum in passage 5 decreases, whereby diaphragm 20 is deflected toward the air chamber 23 by the force of the spring 26. Consequently the micro switch 25 is pushed by the push rod 27 connected to the diaphragm 20 and the vacuum switch 14 produces a fuel enrichment signal or actuating signal. The pulse width supplied to injector 11 is increased in response to this fuel enrichment signal by the electronic control unit 12 to provide the fuel enrichment correction.

Optionally the microswitch 25 can be arranged such that the switch 14 is turned on when the absolute value of the intake vacuum is over a predetermined value. However it is convenient to arrange the microswitch 25 to be ON when the absolute value is under a predetermined value, because the thus arranged vacuum switch can be simply substituted, without any additional change, for a throttle valve switch in a conventional system.

Optionally the present invention can be embodied by using only the vacuum switch 14 without the throttle switch 13 because satisfactory engine performance can be maintained by performing fuel enrichment only in the engine operational ranges A and B in FIG. 2. In this case the set point of the vacuum switch 14 can be determined adequately by considering operation in the absence of the throttle switch 13. For example, the vacuum switch 14 may be set at a slightly greater absolute value of the vacuum than in the case of the combination of the vacuum switch 14 and the throttle switch 13.

Figure 4:
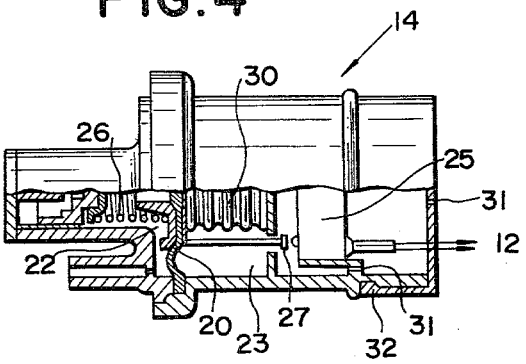

FIG. 4 is an illustration of a modified vacuum switch having an altitude compensation mechanism. When an automobile is operated at high altitudes where the atomospheric pressure is lower than at sea level, the density of the intake air becomes lower and accordingly the throttle valve must be opened more widely to maintain acceptable performance of the automobile. Consequently the absolute value of the intake vacuum becomes lower and the vacuum switch is more easily actuated. As a result, fuel enrichment is started at a lower load condition or before the engine reaches the operating condition where fuel enrichment is really required. This leads to undesired fuel consumption and increased CO and HC in the exhaust gaes.

These drawbacks are eliminated by using the vacuum switch shown in FIG. 4. In FIG. 4, a bellows 30 is provided, as an altitude compensation mechanism, in the air chamber 23 on one side of the diaphragm 20 opposite to the spring 26. Atmospheric pressure, which changes with altitude, is introduced through an air conduit 31 formed in a water tight cap 32 and applied to the outside of the bellows 30. At high altitude, the bellows 30 expands because of a drop of the atmospheric pressure; accordingly bellows 30 slightly moves the diaphragm 20 toward the vacuum chamber 22, increasing a space between the diaphragm and the microswitch 25. Consequently an intake vacuum of a smaller absolute value than in the case where a bellows is not provided drives the push rod 27 as far as the microswitch 25 to turn on the switch. Thus this arrangement delays the time when the microswitch 25 is actuated and fuel enrichment is commanded, reliably preventing undesired increases of fuel consumption and in amounts of CO and HC in the exhaust gases.

Figure 5:
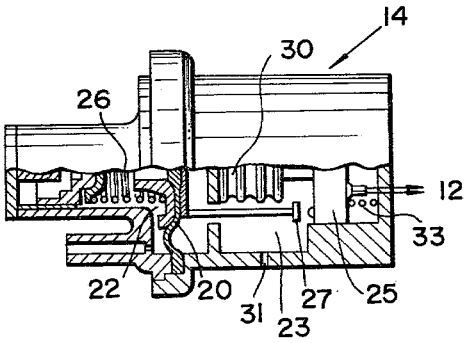

The vacuum switch shown in FIG. 4 can be modified in various ways. FIG. 5 is a diagram of one modification as an example. In FIG. 5, the bellows 30 is arranged to move microswitch 25, instead of the diaphragm 20. At high altitude relatively low magnitude atmospheric pressure is introduced through the air conduit 31 into the air chamber 23 where bellows 30 is disposed, causing bellows 30 to expand to move the microswitch 25 away from the diaphragm 20. Therefore the diaphragm 20 must be deflected further by the aid of a spring 26 in order to drive push rod 27 and bring it in contact with the microswitch.

Figure 6:
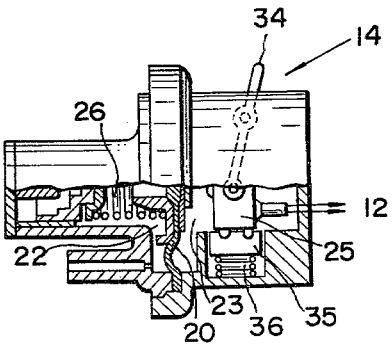

FIG. 6 is an illustration of another modification of the vacuum switch 14. In FIG. 6, there is provided a lever 34 which manually changes the position of the microswitch 25 between a first position adapted for high altitudes and a second position adapted for sea level. The operation of this modification is the same in principle as those of the vacuum switches shown in FIGS. 4 and 5. When the engine is equipped with a manual altitude compensation device for regulating fuel supply to the engine depending on altitude change, it is convenient to connect a lever of such an altitude compensation device with the change lever 34 of the vacuum switch. The microswitch 25 shown in FIG. 6 is moved along a guide 35 containing two recesses for retaining the microswitch and supported by spring 36 in the housing. It is optional to provide more retaining recesses for more precise adjustment or to eliminate the recess for continuous movement of microswitch 25.

In the first embodiment in which the throttle switch 13 and the vacuum switch 14 are used for the fuel enrichment, the fuel is enriched in all the three operating ranges A, B and C in FIG. 2 to such an extent as to provide substantially the same air-fuel ratio. For example, the air-fuel ratio is controlled at 13 in all three ranges A, B and C; in the normal operating range D the air-fuel ratio is controlled at 15. In this case, however, the engine is supplied, even in the range A in FIG. 2, with an air/fuel mixture as rich as required at full throttle so that the production of CO and HC is increased although NOx emission is reduced. Accordingly it is effective to make the amount of the fuel enrichment smaller in the range A than in the ranges B and C so as to provide the moderately enriched air-fuel mixture just suitable to the range A. Thus the amount of NOx can be reduced satisfactorily without excessively increasing CO and HC emission in the range A.

Figure 7:
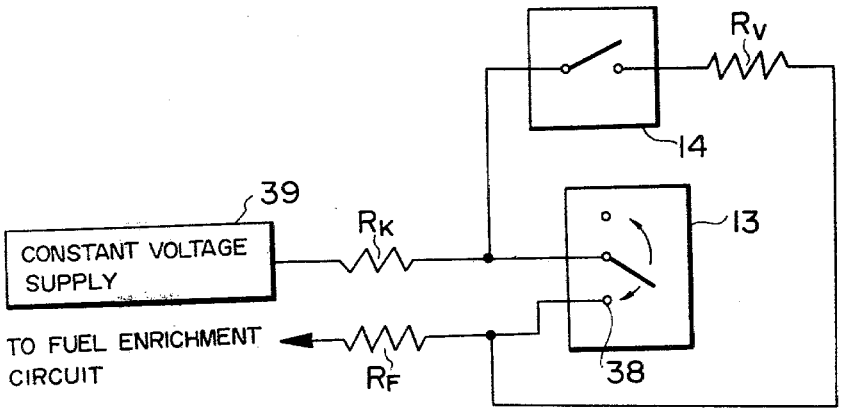
FIG. 7 is a circuit diagram, partly shown in blocks, of the embodiment of the invention.

The electrical circuit shown in FIG. 7 is arranged for this purpose. In FIG. 7, a resistor Rv is connected in series to the vacuum switch 14 and this series combination is connected in parallel to terminals of throttle switch 13. Resistors Rk and Rf are connected in series to the parallel combination of the throttle switch, and the vacuum switch and the resistor Rv. A constant voltage supply 39 supplies a predetermined constant voltage to the circuit. When only the throttle switch 13 is closed in the range C and both the throttle switch 13 and the vacuum switch 14 are closed in the range B, an output current flows through the two resistors Rk and Rf. A fuel enrichment circuit in the control unit 12 responds to this output current to increase the width of the command pulse signal in proportion to the value of the current. When only the vacuum switch 14 is closed while the engine is in range A, a current flows through resistors Rk, Rv and Rf, so that the value of the current is reduced relative to the current flowing through the two resistors Rk and Rf, whereby there is a reduction in the amount of the fuel enrichment. The air-fuel ratio suitable to the range A can be easily obtained by properly choosing the value of the resistor Rv. For example, the air-fuel ratio is controlled at 14 in the range A, 13 in the ranges B and C, and 15 in the range D.

As will be understood from the foregoing description, the vacuum switch according to the present invention is actuated and produces a fuel enrichment signal before the throttle switch for an engine operating at low speed and relatively high load. The fuel enrichment feature is actuated by the fuel enrichment signal of the vacuum switch in this engine operating range. This allows an increase in EGR amount to reduce nitrogen oxide emission without making the engine performance worse.

According to the present invention, the fuel enrichment may be made only by the vacuum switch 14 without the throttle switch 13. In this case the vacuum switch 14 provides the fuel enrichment in the engine operating range of relatively high load which is the smallest range where fuel enrichment is really required. Accordingly this arrangement eliminates the necessity for throttle valve switch 13 and thus reduces cost.

Furthermore, in the case where both the vacuum 14 switch and the throttle switch 13 are provided, the control can be made reliable and accurate with greater degree of freedom. Even if either of switches 13 or 14 malfunctions, acceptable engine performance can be maintained.

In one embodiment of the present invention, the fuel is enriched moderately in the for low speed and relatively high load engine operating conditions, so that NOx emission can be reduced satisfactorily without increasing CO and HC emission in such an engine operating range.

What is claimed is:

1. In an electronic fuel injection system for an internal combustion engine, the system having means for sensing the engine speed, means for measuring the rate of air flow entering the engine, means for calculating optimum fuel injection quantity in accordance with the sensed engine speed and the measured air flow rate and producing a command signal based on the calculation and fuel injector means for injecting a regulated quantity of fuel into the engine in response to the command signal, the improvement comprising;

vacuum sensing means for sensing the absolute value of the intake manifold pressure and producing a first actuating signal when the sensed absolute value of the intake manifold pressure is below a predetermined value, throttle position sensing means for sensing the opening degree of the throttle valve and producing a second actuating signal when the sensed opening degree is beyond a predetermined degree, and means for achieving fuel enrichment by modifying the command signal of said calculating means in response to said first and said second actuating signals when either or both of said first and said second actuating signals are present.

2. The improvement according to claim 1, wherein said vacuum sensing means further comprises an altitude compensation means to compensate for the change in the atmospheric pressure.

3. The improvement according to claim 1, wherein said vacuum sensing means comprises a vacuum switch comprising a housing, a diaphragm disposed in said housing as a partition one side of which is exposed to the atmospheric pressure and the other side to the intake manifold pressure such that said diaphragm moves in relation to the difference between the two pressure, and a switching device arranged to be actuated by the movement of said diaphragm.

4. The improvement according to claim 3, wherein said vacuum switch further comprises an altitude compensation means to compensate for the change in the atmospheric pressure.

5. The improvement according to claim 4, wherein said altitude compensation means comprises a bellows which expands and contracts with changes in the atmospheric pressure and which is arranged to increase and decrease a space between said diaphragm and said switching device with changes in the atmospheric pressure.

6. The improvement according to claim 1, wherein said means for achieving fuel enrichment is so arranged that the amount of the fuel enrichment is smaller when only said first signal is present than when said second signal is present and when both said first and said second signals are present.

7. The improvement according to claim 6, wherein said vacuum sensing means is a vacuum switch arranged to be closed when the sensed absolute value of the intake manifold pressure is below said predetermined value, said throttle position sensing means being a throttle switch arranged to be closed when the sensed opening degree of the throttle valve is beyond said predetermined degree, the improvement further comprising a first resistor connected in series to said throttle switch, a constant voltage supply for applying a predetermined constant voltage to said first resistor to produce an output current of a predetermined value when said throttle switch is closed and a second resistor connected in series to said vacuum switch, the series combination of said vacuum switch and said second resistor being connected in parallel to said throttle switch and connected in series to said first resistor, said constant voltage supply applying said voltage to the series combination of said first and said second resistors when only said vacuum switch is closed so that the value of said output current is reduced, said means for achieving fuel enrichment being so arranged as to provide the amount of the fuel enrichment in proportion to the value of said output current.

* * * * *